US008725391B2

(12) United States Patent
Hofmeister et al.

(10) Patent No.: US 8,725,391 B2
(45) Date of Patent: May 13, 2014

(54) METHOD FOR IDENTIFYING AN ERROR FUNCTION AND IN PARTICULAR A DRIFT OF A RAIL PRESSURE SENSOR IN A COMMON RAIL INJECTION SYSTEM

(75) Inventors: Carl-Eike Hofmeister, Regensburg (DE); Michael Käsbauer, Neutraubling (DE); Matthias Stampfer, Berching (DE)

(73) Assignee: Continental Automotive GmbH, Hannover (DE)

( * ) Notice: Subject to any disclaimer, the term of this patent is extended or adjusted under 35 U.S.C. 154(b) by 841 days.

(21) Appl. No.: 12/994,039

(22) PCT Filed: Apr. 16, 2009

(86) PCT No.: PCT/EP2009/054508

§ 371 (c)(1),
(2), (4) Date: Nov. 22, 2010

(87) PCT Pub. No.: WO2009/141199

PCT Pub. Date: Nov. 26, 2009

(65) Prior Publication Data

US 2011/0098976 A1 Apr. 28, 2011

(30) Foreign Application Priority Data

May 23, 2008 (DE) ..... 10 2008 024 955

(51) Int. Cl.
*F02D 41/22* (2006.01)

(52) U.S. Cl.
USPC ..... 701/107; 701/113; 123/688; 123/690; 123/479; 73/114.43

(58) Field of Classification Search
USPC ..... 701/107, 113; 123/685, 688, 690, 479, 123/491, 511; 73/114.43
See application file for complete search history.

(56) References Cited

U.S. PATENT DOCUMENTS 4,785,771 A * 11/1988 Ibuki et al. ..... 123/179.17
5,241,933 A 9/1993 Morikawa ..... 123/198

(Continued)

FOREIGN PATENT DOCUMENTS

DE 19547647 A1 6/1997 ..... F02D 41/22
DE 19834660 A1 2/2000 ..... F02D 41/22

(Continued)

OTHER PUBLICATIONS

International PCT Preliminary Report on Patentability, PCT/EP2009/054508, 6 pages, Dec. 16, 2010.

(Continued)

*Primary Examiner* — Erick Solis
(74) *Attorney, Agent, or Firm* — King & Spalding L.L.P.

(57) ABSTRACT

In order to locate errors of the rail pressure sensor (38) when starting problems occur, the following method steps are proposed: determination of whether starting problems occur in the engine and if this is the case, an engine state is induced, in which the engine controller is already active but the starting phase of the engine has not yet commenced; substitution of the measured rail pressure sensor value used by the engine controller with a substitute value; start attempt of the engine and determination whether the engine has achieved an independent operation; and identification of an error function of the rail pressure sensor if the starting problems only occur when the measured rail pressure sensor value is used.

20 Claims, 2 Drawing Sheets

(56) References Cited

U.S. PATENT DOCUMENTS

| | | | | |
|---|---|---|---|---|
| 5,351,666 | A * | 10/1994 | Bronkal et al. | 123/359 |
| 6,474,306 | B2 * | 11/2002 | Muller et al. | 123/479 |
| 7,278,405 | B2 * | 10/2007 | Takahashi | 123/514 |
| 7,980,120 | B2 * | 7/2011 | Cinpinski et al. | 73/114.43 |
| 8,521,404 | B2 * | 8/2013 | Chiba et al. | 701/107 |

FOREIGN PATENT DOCUMENTS

| | | | | |
|---|---|---|---|---|
| DE | 10040254 | | 3/2002 | G01M 15/00 |
| DE | 10240069 | A1 | 3/2003 | F02D 41/22 |
| DE | 102005008039 | A1 | 6/2006 | F02M 63/04 |
| DE | 102007015876 | A1 | 12/2007 | F02D 41/22 |
| WO | 95/06814 | A1 | 3/2005 | F02D 41/22 |

OTHER PUBLICATIONS

German Office Action, German Patent Application No. 10 2008 024 955.6-26, 2 pages, Feb. 6, 2009.

International PCT Search Report and Written Opinion, PCT/EP2009/054508, 12 pages, Jul. 28, 2009.

* cited by examiner

METHOD FOR IDENTIFYING AN ERROR FUNCTION AND IN PARTICULAR A DRIFT OF A RAIL PRESSURE SENSOR IN A COMMON RAIL INJECTION SYSTEM

CROSS-REFERENCE TO RELATED APPLICATIONS

This application is a U.S. National Stage Application of International Application No. PCT/EP2009/054508 filed Apr. 16, 2009, which designates the United States of America, and claims priority to German Application No. 10 2008 024 955.6 filed May 23, 2008, the contents of which are hereby incorporated by reference in their entirety.

TECHNICAL FIELD

The invention relates to a method for identifying an error function and in particular a drift of a rail pressure sensor in a common rail injection system of an internal combustion engine.

BACKGROUND

Such a method is known example from DE 10 2007 015 876 A1.

Modern internal combustion engines are provided with a common rail injection system with which fuel is conveyed by a pump into a pressure reservoir (common rail) and is pressurized. The fuel is then injected from the common rail via controllable injectors into the combustion chambers of the internal combustion engine.

A common rail injection system is known for example from DE 198 34 660. The common rail is provided with a rail pressure sensor with which the pressure in the rail is measured, with a pressure valve and/or the pump of the injection system being controlled using open-loop and/or closed-loop control depending on the measured pressure. The (analog) pressure signal of the rail pressure sensor which is processed in the control device is thus the control variable for closed-loop control of the rail pressure. An error function of the rail pressure sensor or drift behavior during operation and over the lifetime of the rail pressure sensor respectively have a negative affect on the accuracy of the setpoint pressure to be set and thereby on the precision of the injection amount.

Component faults occurring in the common rail injection system frequently lead to undesired vehicle behavior in which the engine is only able to be started with difficulty or is no longer able to be started at all. On-board diagnosis systems only allow the precise cause of the error in the injection system to be determined to a restricted extent for starting problems, for example with an electrical short circuit, without any active intervention into the system. This also applies especially for a defective rail pressure sensor e.g. one exhibiting an offset, but free from electrical errors however. Typically it is then only possible to detect whether the rail pressure control is approaching a limit, without actually being able to fully distinguish whether a valve or the rail pressure sensor is now defective for example.

Because of this lack of knowledge of the precise cause of the error unnecessary components or too many components are frequently replaced. Thus the described undesired vehicle behavior can typically initially lead to the replacement of the high-pressure pump although the start problem is actually being caused by a drifted rail pressure sensor.

In order to undertake the corresponding repair in a targeted manner in the case of an error in the operation of an internal combustion engine, a method for the diagnosis of the component, especially a rail pressure sensor, of an internal combustion engine is proposed in DE 100 40 254 B4 in which a component which can be the direct cause of an error—combustion outliers are exclusively cited—is checked by the internal combustion engine being explicitly put into a checking state in which the component cannot be the indirect cause of the error which has occurred and a check is then made as to whether the same error is occurring. In detail the explicit switching-off of the rail pressure sensor contained in a closed-loop control path is discussed, with the pressure control valve being controlled after switching off such that the pressure in the rail assumes a so-called default pressure. As an alternative to introducing the test operating state by switching off the component, in the cited patent document it is also mentioned that the component, for example a sensor, can be explicitly replaced by a model valid in specific operating states. It is proposed in particular that the signal delivered by a sensor be computed from the signals of other sensors and that the test mode of the internal combustion engine be based on these computed variables.

SUMMARY

According to various embodiments, a method can be created which, for starting problems of the engine, makes possible a diagnosis of the rail pressure sensor, especially in respect of the presence of drift effects.

According to an embodiment, a method for detecting an error function and especially a drift of a rail pressure sensor in a common rail injection system of an internal combustion engine, may comprise the following steps:—Establishing whether starting difficulties of the engine are occurring and, if such difficulties are occurring,—Instigating an engine state, in which the engine controller is already active, but the start-up phase of the engine has not yet begun however,—Replacing the measured rail pressure sensor value used by the engine controller by a replacement value predetermined for detecting an error function of the rail pressure sensor,—Attempting to start the engine and subsequently establishing whether autonomous operation of the engine is achieved,—Detecting an error function of the rail pressure sensor if the starting difficulties only occur when the measured rail pressure sensor value is used.

According to a further embodiment, the measured rail pressure sensor value can be changed slowly and constantly enough to the replacement value for the engine controller not to diagnose any electrical error function of the rail pressure sensor. According to a further embodiment, a rail pressure sensor value valid for a model in specific operating states of the start phase of the engine can be determined and is prespecified as the replacement value. According to a further embodiment, a rail pressure setpoint value valid in specific operating states of the start phase of the engine in accordance with the control strategy implemented by the engine controller can be accepted or modified and can be predetermined as the replacement value. According to a further embodiment, the error function detection can be undertaken on-board while the vehicle is operating. According to a further embodiment, on detection of an error function of the rail pressure sensor, the engine can be started and can be operated by permanently replacing the measured rail pressure sensor value by a replacement value in an emergency mode with predetermined emergency reactions. According to a further embodiment, a computer program for executing the method on a computer can be used. According to a further embodiment, the computer program can be stored in a flash memory of a vehicle service facility external to the vehicle. According to a further embodiment, the computer program can be stored in a flash memory of the engine control.

DETAILED DESCRIPTION

The solution according to various embodiments of the above problem therefore comprises the following steps: Determining whether starting difficulties of the engine are occurring and, if they are, initiating an engine state in which the engine control is already active but the starting phase of the engine has however not yet begun, replacing the measured rail pressure sensor value used by the engine control by a predetermined replacement value for detecting an error function of the rail pressure sensor, attempting to start the engine and establishing whether autonomous operation of the engine is achieved and detecting an error function of the rail pressure sensor if the starting difficulties only occur when the measured rail pressure sensor value is used.

The various embodiments are based on the knowledge that adding a replacement value to the rail pressure sensor value allows conclusions to be drawn about relationships that exist or do not exist respectively between the start problems and the rail pressure sensor. This makes it possible for various embodiments to pinpoint the cause of the error in the injection system for starting problems.

According to an embodiment, the replacement value is implemented in a manner almost tricking the engine controller, with the measured rail pressure sensor value being changed so slowly and constantly to the replacement value that the engine controller does not diagnose any electrical malfunction of the rail pressure sensor.

According to a further embodiment of these forms of embodiment the replacement value can be specified in a simple manner by a rail pressure sensor value valid as a model in specific operating states of the start phase of the engine being determined and specified as the replacement value. As an alternative, a rail pressure setpoint value valid in specific operating states of the start phase of the engine in accordance with the control strategy implemented by the engine controller can be accepted or modified and predetermined as the replacement value.

The method according to various embodiments is especially suitable for execution in well-defined operating conditions which are present in particular in the workshop, but typically also for stationary vehicle operating conditions (e.g. vehicle at a standstill, driver attempting to start the vehicle). Error function detection can advantageously be carried out on board during operation of the vehicle. In accordance with a development of these forms of embodiment, when an error function of the rail pressure sensor is detected, the engine can be started and operated in an emergency mode by permanent replacement of the measured rail pressure sensor value by the replacement value with predetermined emergency mode reactions.

To execute the method a computer program on a computer can advantageously be used, which can be stored outside or inside the vehicle, for example in an engine controller or the transmission controller.

Figure 1:
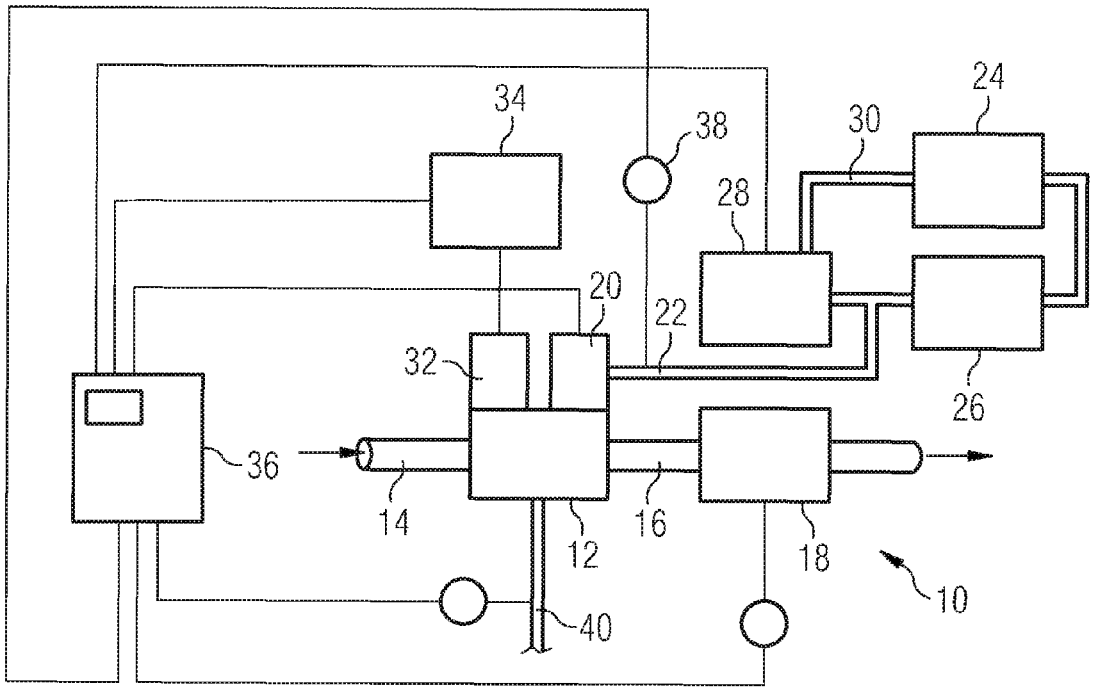
FIG 1 Prior art
FIG. 1 shows a block diagram of an internal combustion engine with common rail injection system known from the prior art.

FIG. 1 shows a sketch of a basic diagram of an internal combustion engine with common rail injection system, with the internal combustion engine as a whole being labeled with the reference sign 10. The engine 10 essentially comprises a combustion chamber 12 to which air is supplied via an induction pipe 14. The combustion exhaust gases are removed through an exhaust pipe 16 with catalytic converter 18. Fuel enters the combustion chamber 12 via high-pressure injection valves 22 to which fuel is supplied via a collective fuel line referred to as a rail 22. This in its turn is connected to a fuel tank 24 and is pressurized by a high-pressure pump 26. A pressure control valve 28 is connected on one side to the rail 22 and on the other side to a return flow line 30 back to the fuel tank 24.

Also shown in FIG. 1 in the combustion chamber 12 are spark plugs 32, which are supplied by an ignition or glow system 34, as well as a crankshaft 40.

The internal combustion engine 10 also comprises an engine controller 36 which is connected on the output side to the glow system 34, the high pressure injection valves 20 and the pressure control valve 28. On the input side the engine control 36 receives signals from a rail pressure sensor 38 which detects the fuel pressure in the rail 22. The rail pressure sensor 38, the pressure control valve 28 and the engine control 36 form a closed-loop control circuit for controlling the pressure in the rail 22. Depending on the pressure signal provided by the rail pressure sensor 38 as well as the output signals of further sensors, the engine controller 36 applies control signals to the injector 20 which control the dispensing of the fuel. The injector 20 then injects the fuel stored in the rail 22.

The start condition for the method according to various embodiments is that the engine can no longer be started or it is only possible to start the engine with difficulty. In the upper part of FIGS. 2 and 3 the abbreviation IGK designates an engine state in which only ignition key (if implemented) and engine controller 36 are activated. The abbreviation CRK means a state in which the engine is in the start-up phase. IS/PL finally means an engine state for example idling or load in which a stable operation of the engine is achieved. The sections of the engine state curves shown correspond in time terms to the sections shown in the lower parts of the respective figures of the signal curves of the rail pressure sensor value.

Figure 2:
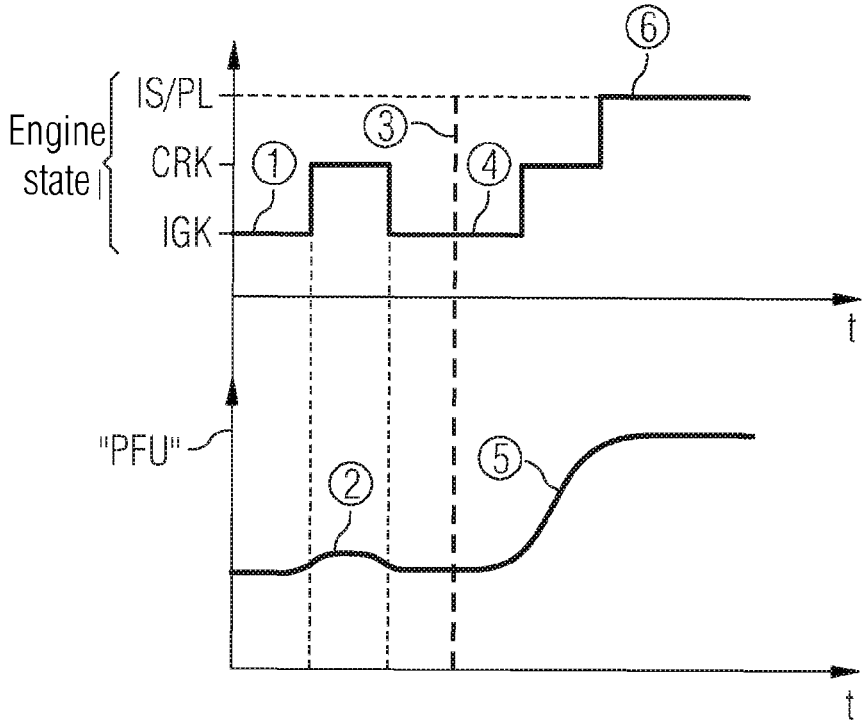
FIG. 2 illustrates the detection of a defective rail pressure sensor according to various embodiments. Plotted in the upper section of the diagram shown is the temporal curve of the engine state in the start phase and in the lower section of the diagram the temporal curve of the rail pressure sensor value.

In section 1 of the engine state curve of FIG. 2 and thereafter a (first) start-up of the engine is undertaken, which does not however lead to autonomous operation of the engine but only up to engine state CRK. The rail pressure sensor value "PFU" used by the engine control 36 in each case is shown in the lower part of FIG. 2. In section 2 the result is a minimal perceptible increase in pressure which is not sufficient for engine start however. In time section 3 there is therefore a switchover to the replacement value of the rail pressure sensor value, with the replacement pressure being connected in a delayed or constant manner respectively, cf. the rising curve in section 5, to the—measured—rail pressure sensor value in section 2. In section 4 there is a renewed attempt at starting which in this case leads to a stable engine state with the engine running, section 6. In the case shown in FIG. 2 an engine start is thus possible again after switching over to the replacement value, from which a defective rail pressure sensor can be deduced.

Figure 3:
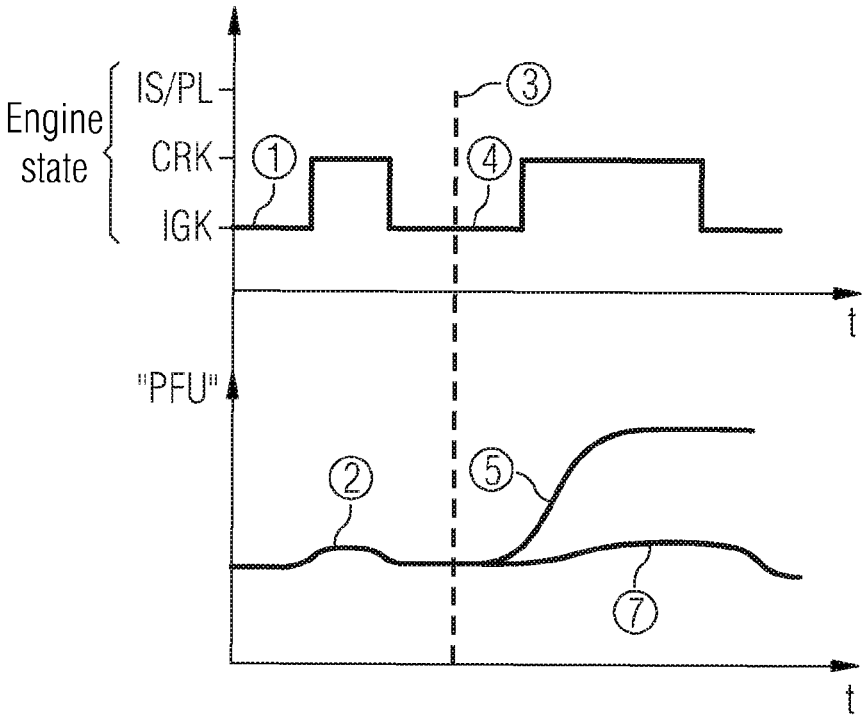
FIG. 3 illustrates, using the same form of presentation as FIG. 2, the detection of a non-defective rail pressure sensor according to various embodiments.

In the case depicted in FIG. 3 there is also a switchover to the replacement value in time section 3. Although the rail pressure sensor value used by the engine control 36 accordingly again rises to the replacement value, cf. Section 5, the real pressure in rail 22 also indicated in the lower part of FIG. 3, cf. Section 7, remains minimal, which corresponds to the case shown in the upper part of FIG. 3 that the new start in section 4—despite replacement value—has not led to an engine start (but only up to engine state CRK). In this case, even after switchover to the replacement value, an engine start is still not possible, from which it can be concluded that the real pressure sensor is not defective so that further error tracing is necessary.

The test intervention according to various embodiments is undertaken such that the measured rail pressure sensor value is replaced by a value able to be predetermined within the test routine. This can for example be a valid setpoint value from the engine controller valid in accordance with the closed-loop control strategy or a valid modeled value, for example a computed value. The engine controller uses or processes this replacement value in the same way as a measured rail pressure sensor value. Afterwards a renewed attempt is made to start the engine, compare the respective sections 4 in FIGS. 2 and 3.

The relationship between system reaction and diagnosis according to various embodiments is thus essentially produced as follows:

If, after replacement of the measured rail pressure sensor value by the replacement value autonomous operation of the engine, for example idling, is achieved, a defective rail pressure sensor, especially a rail pressure sensor affected by a sensor drift, is detected. If not, this is taken as an indication that the rail pressure sensor is operable. In this case further error tracing is necessary.

With on-board execution of the test routine according to various embodiments, for a detected sensor error an engine start and thus vehicle operation might still be possible again. Suitable emergency reactions are to be defined for this (e.g. MIL on, speed limiting etc.) in order to encourage the driver to take the vehicle for repair.

Storage of a corresponding error code gives the workshop the information for replacing the defective rail pressure sensor, or makes it possible in the event that there is no error (no sensor drift) to conduct a more targeted further error search.

What is claimed is:

1. A method for detecting an error function and especially a drift of a rail pressure sensor in a common rail injection system of an internal combustion engine, comprising the following steps:

Establishing whether starting difficulties of the engine are occurring and, if such difficulties are occurring, Instigating an engine state, in which the engine controller is already active, but the start-up phase of the engine has not yet begun however, Replacing the measured rail pressure sensor value used by the engine controller by a replacement value predetermined for detecting an error function of the rail pressure sensor, Attempting to start the engine and subsequently establishing whether autonomous operation of the engine is achieved, Detecting an error function of the rail pressure sensor if the starting difficulties only occur when the measured rail pressure sensor value is used.

2. The method according to claim 1, wherein the measured rail pressure sensor value is changed slowly and constantly enough to the replacement value for the engine controller not to diagnose any electrical error function of the rail pressure sensor.

3. The method according to claim 1, wherein a rail pressure sensor value valid for a model in specific operating states of the start phase of the engine is determined and is prespecified as the replacement value.

4. The method according to claim 1, wherein a rail pressure setpoint value valid in specific operating states of the start phase of the engine in accordance with the control strategy implemented by the engine controller is accepted or modified and is predetermined as the replacement value.

5. The method according to claim 1, wherein the error function detection is undertaken on-board while the vehicle is operating.

6. The method according to claim 5, wherein, on detection of an error function of the rail pressure sensor, the engine is started and is operated by permanently replacing the measured rail pressure sensor value by a replacement value in an emergency mode with predetermined emergency reactions.

7. The method according to claim 1, wherein a computer program for executing the method on a computer is used.

8. The method according to claim 7, wherein the computer program is stored in a flash memory of a vehicle service facility external to the vehicle.

9. The method according to claim 7, wherein the computer program is stored in a flash memory of the engine control.

10. A system for detecting an error function and especially a drift of a rail pressure sensor in a common rail injection system of an internal combustion engine, comprising an engine controller, and a rail pressure sensor in a common rail injection system of an internal combustion engine;

wherein the system is operable:

to establish whether starting difficulties of the engine are occurring and, if such difficulties are occurring, to instigate an engine state, in which the engine controller is already active, but the start-up phase of the engine has not yet begun however, to replace the measured rail pressure sensor value used by the engine controller by a replacement value predetermined for detecting an error function of the rail pressure sensor, to attempt to start the engine and subsequently establishing whether autonomous operation of the engine is achieved, and to detect an error function of the rail pressure sensor if the starting difficulties only occur when the measured rail pressure sensor value is used.

11. The system according to claim 10, wherein the system is operable to change the measured rail pressure sensor value slowly and constantly enough to the replacement value for the engine controller not to diagnose any electrical error function of the rail pressure sensor.

12. The system according to claim 10, wherein the system is operable to determine a rail pressure sensor value valid for a model in specific operating states of the start phase of the engine and to prespecify the rail pressure sensor value as the replacement value.

13. The system according to claim 10, wherein the system is operable to accept or modify a rail pressure setpoint value valid in specific operating states of the start phase of the engine in accordance with the control strategy implemented by the engine controller and to predetermine the rail pressure setpoint value as the replacement value.

14. The system according to claim 10, wherein the system is operable to undertake the error function detection on-board while the vehicle is operating.

15. The system according to claim 14, wherein the system is operable to start, on detection of an error function of the rail pressure sensor, the engine and to operate the engine by permanently replacing the measured rail pressure sensor value by a replacement value in an emergency mode with predetermined emergency reactions.

16. The system according to claim 10, wherein the system is programmed by a computer program.

17. The system according to claim 16, wherein the computer program is stored in a flash memory of a vehicle service facility external to the vehicle.

18. The system according to claim 10, wherein the computer program is stored in a flash memory of the engine controller.

19. The system according to claim 10, wherein the internal combustion engine comprises a combustion chamber to which air is supplied via an induction pipe, wherein combustion exhaust gases are removed through an exhaust pipe with catalytic converter, wherein fuel enters the combustion chamber via high-pressure injection valves to which fuel is supplied via a collective fuel line connected to a fuel tank and pressurized by a high-pressure pump, and wherein a pressure control valve is connected on one side to the collective fuel line and on the other side to a return flow line back to the fuel tank.

20. The system according to claim 19, wherein the engine controller is connected on the output side to a glow system, the high pressure injection valves and the pressure control valve, wherein on the input side the engine controller receives signals from a rail pressure sensor which detects the fuel pressure in the collective fuel line, and wherein the rail pressure sensor, the pressure control valve and the engine controller form a closed-loop control circuit for controlling the pressure in the collective fuel line.

* * * * *